US009847085B2

(12) United States Patent
Philippe et al.

(10) Patent No.: US 9,847,085 B2
(45) Date of Patent: Dec. 19, 2017

(54) FILTERING IN THE TRANSFORMED DOMAIN

(75) Inventors: Pierrick Philippe, Melesse (FR); David Virette, Munich (DE)

(73) Assignee: Orange, Paris (FR)

( * ) Notice: Subject to any disclaimer, the term of this patent is extended or adjusted under 35 U.S.C. 154(b) by 380 days.

(21) Appl. No.: 13/995,718

(22) PCT Filed: Dec. 16, 2011

(86) PCT No.: PCT/FR2011/053024
§ 371 (c)(1),
(2), (4) Date: Jun. 19, 2013

(87) PCT Pub. No.: WO2012/085410
PCT Pub. Date: Jun. 28, 2012

(65) Prior Publication Data

US 2013/0282387 A1 Oct. 24, 2013

(30) Foreign Application Priority Data

Dec. 23, 2010 (FR) ..... 10 61187

(51) Int. Cl.

| | |
|---|---|
| ***G10L 19/00*** | (2013.01) |
| ***G10L 19/26*** | (2013.01) |
| *G10L 19/02* | (2013.01) |
| *G10L 19/022* | (2013.01) |

(52) U.S. Cl.
CPC ..... *G10L 19/00* (2013.01); *G10L 19/26* (2013.01); *G10L 19/02* (2013.01); *G10L 19/022* (2013.01); *G10L 19/0204* (2013.01); *G10L 19/0212* (2013.01)

(58) Field of Classification Search
CPC .... G10L 19/02; G10L 19/022; G10L 19/0204
USPC ..... 704/500, 503, E21.001
See application file for complete search history.

(56) References Cited

U.S. PATENT DOCUMENTS

2003/0016772 A1* 1/2003 Ekstrand ..... H03H 17/0266 375/350
2003/0171918 A1* 9/2003 Sall ..... G10L 21/0208 704/216
2005/0149339 A1 7/2005 Tanaka et al.
(Continued)

FOREIGN PATENT DOCUMENTS

WO WO 2008/014853 A1 2/2008

OTHER PUBLICATIONS

Kuech, "Aliasing Reduction for Modified Discrete Cosine Transform Domain Filtering and its Application to Speech Enhancement," IEEE Workshop on Applications of Signal Processing to Audio and Acoustics, 2007.*
(Continued)

*Primary Examiner* — Pierre-Louis Desir
*Assistant Examiner* — Forrest F Tzeng
(74) *Attorney, Agent, or Firm* — Drinker Biddle & Reath LLP

(57) ABSTRACT

A method for processing a signal in the form of consecutive sample blocks, the method comprising filtering in a transformed domain of sub-bands, and particularly equalization processing, applied to a current block in the transformed domain, and filtering-adjustment processing that is applied in the transformed domain to at least one block adjacent to the current block.

28 Claims, 13 Drawing Sheets

(56) References Cited

U.S. PATENT DOCUMENTS

| | | | | |
|---|---|---|---|---|
| 2007/0067167 | A1* | 3/2007 | Barford | G06F 17/141 704/226 |
| 2009/0319283 | A1* | 12/2009 | Schnell | H03H 17/0266 704/503 |
| 2011/0004478 | A1* | 1/2011 | Jax | G10L 19/173 704/500 |
| 2011/0302230 | A1* | 12/2011 | Ekstrand | H03H 17/0266 708/201 |
| 2012/0051559 | A1* | 3/2012 | Zeng | H03G 9/025 381/103 |
| 2013/0208917 | A1* | 8/2013 | Fielder | H04R 3/04 381/103 |

OTHER PUBLICATIONS

Lin, et al. "A digital audio equalizer using MDCT filter bank," IEEE Inter. Conf. Consumer Electronics, 1992.*

Edler, "Aliasing Reduction in Sub-Bands of Cascaded Filter Banks with Decimation," Electronics Letters, Jun. 1992.*

Edler, "Aliasing Reduction for Gain Control with Critically Sampled Filter Banks," First International Conference on Communications and Electronics, 2006, ICCE'06, IEEE, PI, pp. 315-318 (Oct. 1, 2006).

Kuech et al., "Aliasing Reduction for Modified Discrete Cosine Transform Domain Filtering and its Application to Speech Enhancement," 2007 IEEE Workshop on Applications of Signal Processing to Audio and Acoustics, Oct. 21-24, 2007, New Paltz, NY, IEEE, pp. 131-134 (Oct. 24, 2007).

Office Action issued for CN 201180067872.4 (dated May 21, 2015).

* cited by examiner

FIG. 1A
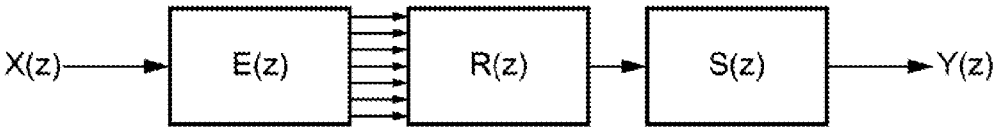
FIG. 1B
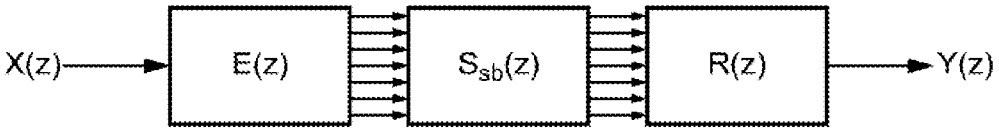
FIG. 2
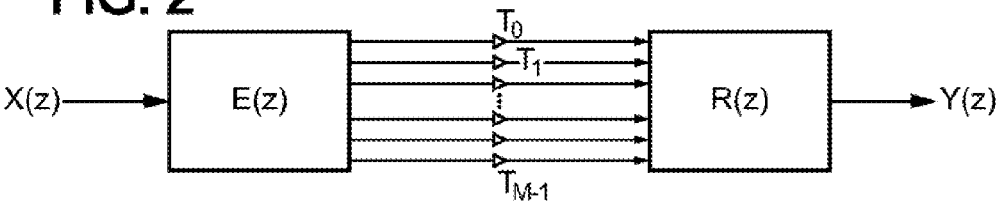
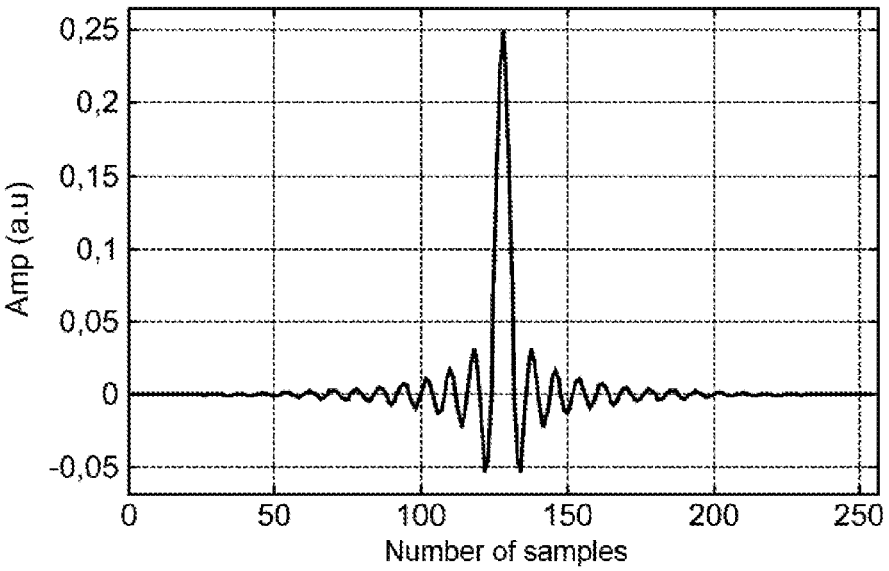
FIG. 3

*FIG. 15*

| index | diag(T0,0) | diag(T1,0) | diag(T1,1) | diag(T1,3) |
|---|---|---|---|---|
| 0 | 1 | 0 | 0 | 0 |
| ... | ... | ... | ... | ... |
| M/4-2 | 1 | 0 | 0 | $a_5$ |
| M/4-1 | 1 | 0 | $a_3$ | $-a_4$ |
| M/4 | $1-a_0$ | $-a_1$ | $-a_2$ | $a_5$ |
| M/4+1 | $a_0$ | $a_1$ | $a_3$ | 0 |
| M/4+2 | 0 | 0 | 0 | 0 |
| ... | ... | ... | ... | ... |
| M-1 | 0 | 0 | 0 | 0 |

*FIG. 16*

| index | diag(T0,0) | diag(T1,0) | diag(T1,1) | diag(T1,3) |
|---|---|---|---|---|
| 0 | 0 | 0 | 0 | 0 |
| ... | ... | ... | ... | ... |
| M/8-3 | 0 | 0 | 0 | 0 |
| M/8-2 | 0 | 0 | 0 | $-a_5$ |
| M/8-1 | 0 | 0 | $-a_3$ | $a_4$ |
| M/8 | $a_0$ | $a_1$ | $a_2$ | $-a_5$ |
| M/8+1 | $1-a_0$ | $-a_1$ | $-a_3$ | 0 |
| M/8+2 | 1 | 0 | 0 | 0 |
| ... | ... | ... | ... | ... |
| M/4-2 | 1 | 0 | 0 | $a_5$ |
| M/4-1 | 1 | 0 | $a_3$ | $-a_4$ |
| M/4 | $1-a_0$ | $-a_1$ | $-a_2$ | $a_5$ |
| M/4+1 | $a_0$ | $a_1$ | $a_3$ | 0 |
| M/4+2 | 0 | 0 | 0 | 0 |
| ... | ... | ... | ... | ... |
| M-1 | 0 | 0 | 0 | 0 |

*FIG. 17*

| | Band-pass | | | | | Low-pass | | | |
|---|---|---|---|---|---|---|---|---|---|
| index | diag(T0,0) | diag(T1,0) | diag(T1,1) | diag(T1,3) | | diag(T0,0) | diag(T1,0) | diag(T1,1) | diag(T1,3) |
| 0 | 0 | 0 | 0 | 0 | | 1 | 0 | 0 | 0 |
| ... | ... | ... | ... | ... | | ... | ... | ... | ... |
| M/8-3 | 0 | 0 | 0 | 0 | | 1 | 0 | 0 | 0 |
| M/8-2 | 0 | 0 | 0 | $-a_5$ | | 1 | 0 | 0 | $a_5$ |
| M/8-1 | 0 | 0 | $-a_3$ | $a_4$ | | 1 | 0 | $a_3$ | $-a_4$ |
| M/8 | $a_0$ | $a_1$ | $a_2$ | $-a_5$ | | $1-a_0$ | $-a_1$ | $-a_2$ | $a_5$ |
| M/8+1 | $1-a_0$ | $-a_1$ | $-a_3$ | 0 | | $a_0$ | $a_1$ | $a_3$ | 0 |
| M/8+2 | 1 | 0 | 0 | 0 | | 0 | 0 | 0 | 0 |
| ... | ... | ... | ... | ... | | ... | ... | ... | ... |
| M/4-2 | 1 | 0 | 0 | $a_5$ | | 0 | 0 | 0 | 0 |
| M/4-1 | 1 | 0 | $a_3$ | $-a_4$ | | 0 | 0 | 0 | 0 |
| M/4 | $1-a_0$ | $-a_1$ | $-a_2$ | $a_5$ | | 0 | 0 | 0 | 0 |
| M/4+1 | $a_0$ | $a_1$ | $a_3$ | 0 | | 0 | 0 | 0 | 0 |
| M/4+2 | 0 | 0 | 0 | 0 | | 0 | 0 | 0 | 0 |
| ... | ... | ... | ... | ... | | ... | ... | ... | ... |
| M-1 | 0 | 0 | 0 | 0 | | 0 | 0 | 0 | 0 |

*FIG. 18*

| index | diag(T0,0) | diag(T1,0) | diag(T1,1) | diag(T1,3) |
|---|---|---|---|---|
| 0 | 1 | 0 | 0 | 0 |
| ... | ... | ... | ... | ... |
| M/8-3 | 1 | 0 | 0 | 0 |
| M/8-2 | 1 | 0 | 0 | 0 |
| M/8-1 | 1 | 0 | 0 | 0 |
| M/8 | 1 | 0 | 0 | 0 |
| M/8+1 | 1 | 0 | 0 | 0 |
| M/8+2 | 1 | 0 | 0 | 0 |
| ... | ... | ... | ... | ... |
| M/4-2 | 1 | 0 | 0 | $a_5$ |
| M/4-1 | 1 | 0 | $a_3$ | $-a_4$ |
| M/4 | $1-a_0$ | $-a_1$ | $-a_2$ | $a_5$ |
| M/4+1 | $a_0$ | $a_1$ | $a_3$ | 0 |
| M/4+2 | 0 | 0 | 0 | 0 |
| ... | ... | ... | ... | ... |
| M-1 | 0 | 0 | 0 | 0 |

*FIG. 19*

| | Band-pass (weight x1) | | | | | Low-pass (weight x10) | | | |
|---|---|---|---|---|---|---|---|---|---|
| index | diag(T0,0) | diag(T1,0) | diag(T1,1) | diag(T1,3) | | diag(T0,0) | diag(T1,0) | diag(T1,1) | diag(T1,3) |
| 0 | 0 | 0 | 0 | 0 | | 1 | 0 | 0 | 0 |
| ... | ... | ... | ... | ... | | ... | ... | ... | ... |
| M/8-3 | 0 | 0 | 0 | 0 | | 1 | 0 | 0 | 0 |
| M/8-2 | 0 | 0 | 0 | $-a_5$ | | 1 | 0 | 0 | $a_5$ |
| M/8-1 | 0 | 0 | $-a_3$ | $a_4$ | | 1 | 0 | $a_3$ | $-a_4$ |
| M/8 | $a_0$ | $a_1$ | $a_2$ | $-a_5$ | | $1-a_0$ | $-a_1$ | $-a_2$ | $a_5$ |
| M/8+1 | $1-a_0$ | $-a_1$ | $-a_3$ | 0 | | $a_0$ | $a_1$ | $a_3$ | 0 |
| M/8+2 | 1 | 0 | 0 | 0 | | 0 | 0 | 0 | 0 |
| ... | ... | ... | ... | ... | | ... | ... | ... | ... |
| M/4-2 | 1 | 0 | 0 | $a_5$ | | 0 | 0 | 0 | 0 |
| M/4-1 | 1 | 0 | $a_3$ | $-a_4$ | | 0 | 0 | 0 | 0 |
| M/4 | $1-a_0$ | $-a_1$ | $-a_2$ | $a_5$ | | 0 | 0 | 0 | 0 |
| M/4+1 | $a_0$ | $a_1$ | $a_3$ | 0 | | 0 | 0 | 0 | 0 |
| M/4+2 | 0 | 0 | 0 | 0 | | 0 | 0 | 0 | 0 |
| ... | ... | ... | ... | ... | | ... | ... | ... | ... |
| M-1 | 0 | 0 | 0 | 0 | | 0 | 0 | 0 | 0 |

*FIG. 20*

| | Band-pass (weight x1) | | | | | Low-pass (weight x10) | | | |
|---|---|---|---|---|---|---|---|---|---|
| index | diag(T0,0) | diag(T1,0) | diag(T1,1) | diag(T1,3) | | diag(T0,0) | diag(T1,0) | diag(T1,1) | diag(T1,3) |
| 0 | 0 | 0 | 0 | 0 | | G | 0 | 0 | 0 |
| ... | ... | ... | ... | ... | | ... | ... | ... | ... |
| M/8-3 | 0 | 0 | 0 | 0 | | G | 0 | 0 | 0 |
| M/8-2 | 0 | 0 | 0 | $-a_5$ | | G | 0 | 0 | $(g-1).a_5$ |
| M/8-1 | 0 | 0 | $-a_3$ | $a_4$ | | G | 0 | $(g-1).a_3$ | $-(g-1).a_4$ |
| M/8 | $a_0$ | $a_1$ | $a_2$ | $-a_5$ | | $g.(1-a_0)+a_0$ | $-(g-1).a_1$ | $-(g-1).a_2$ | $(g-1).a_5$ |
| M/8+1 | $1-a_0$ | $-a_1$ | $-a_3$ | 0 | | $(1-a_0)+g.a_0$ | $(g-1).a_1$ | $(g-1).a_3$ | 0 |
| M/8+2 | 1 | 0 | 0 | 0 | | 1 | 0 | 0 | 0 |
| ... | ... | ... | ... | ... | | ... | ... | ... | ... |
| M/4-2 | 1 | 0 | 0 | $a_5$ | | 1 | 0 | 0 | $a_5$ |
| M/4-1 | 1 | 0 | $a_3$ | $-a_4$ | | 1 | 0 | $a_3$ | $-a_4$ |
| M/4 | $1-a_0$ | $-a_1$ | $-a_2$ | $a_5$ | | $1-a_0$ | $-a_1$ | $-a_2$ | $a_5$ |
| M/4+1 | $a_0$ | $a_1$ | $a_3$ | 0 | | $a_0$ | $a_1$ | $a_3$ | 0 |
| M/4+2 | 0 | 0 | 0 | 0 | | 0 | 0 | 0 | 0 |
| ... | ... | ... | ... | ... | | ... | ... | ... | ... |
| M-1 | 0 | 0 | 0 | 0 | | 0 | 0 | 0 | 0 |

FILTERING IN THE TRANSFORMED DOMAIN

CROSS-REFERENCE TO RELATED APPLICATIONS

This application is the U.S. national phase of the International Patent Application No. PCT/FR2011/053024 filed Dec. 16, 2011, which claims the benefit of French Application No. 1061187 filed Dec. 23, 2010, the entire content of which is incorporated herein by reference.

FIELD

The invention relates to the filtering of digital data, particularly the filtering of audio digital data.

BACKGROUND

The use of low bit-rate audio encoding requires filtering in the decoding post-processing, which can occur in various forms:

- customizing the listening experience by changing the characteristic sound of the recording, in particular by attenuating or amplifying certain bands of the audio spectrum,
- applying filtering in the audio encoding as well, where configuration tools allow enhancing the audio signal received.

For example, techniques such as Spectral Band Replication (SBR) or Parametric Stereo (PS) (ISO/IEC 14496-3 standard, MPEG-4 Audio standard) respectively allow reconstructing higher frequency sounds from lower frequencies and stereo sound from a mono signal. MPEG Surround MPS (ISO/IEC 23003-1 standard, MPEG-D standard) extends the approach of PS processing to the reconstruction of more than two audio channels.

In these techniques, the missing portions of the sound are reconstructed by signal copying and filtering operations.

For example, SBR processing modulates the lower frequency areas to higher frequencies and adjusts the frequency energy of the signal. This adjustment allows obtaining a signal after decoding that is similar to the original signal (signal before encoding).

PS processing recreates, from a mono signal, two composite signals in which the frequency energy is adjusted, again in order to render a decoded signal resembling the original reference signal. MPS processing extends this principle to the generation of N signals from M transmitted audio channels (where $N \geq M$).

Low bit-rate audio encoders using transforms according to MPEG standards such as MP3, AAC or USAC, or according to ITU-T standards such as G.722.1, G.719, G.718, prefer the use of critically sampled transforms. Critical sampling is an important property in low bit-rate encoding. In effect, in order to maintain transmission efficiency, there should not be more transformed samples transmitted than there were in the time domain.

For this reason, in current low bit-rate encoders, only critically sampled transforms are employed. These are, for example, MDCT (Modified Discrete Cosine Transform) transforms which are typically transforms with real number coefficients.

These transforms are unsuitable for filtering without artifacts, because they result in a distortion known as "aliasing".

To achieve adequate filtering, two families of techniques can be applied:

1. those consisting of performing the inverse transformation, then applying a convolution-type filtering;
2. those consisting of using a transformation adapted for filtering (for example a short-term Fourier transform or another transformation for complex values, for example complex filters such as PQMF for Pseudo Quadrature Mirror Filters), which is not critically sampled, in order to be able to perform this filtering operation without artifacts: the filtering then consists of a simple multiplication by transform coefficient (equalization). However, the inverse transformation of the encoding transformation must be performed, then the samples must be transposed to the domain of complex values; after equalization, the samples are restored by inverse complex transformation in the time domain. Three transformations are therefore necessary.

To carry out the first approach (point 1 above), a convolution-type filtering must be performed after inverse transformation of the encoding, which is costly in terms of computation and is not very versatile (little flexibility in making changes to the implemented filter).

The second approach (point 2) is much more versatile, and it is easy to change the multiplier coefficients (the equalization function). On the other hand, the number of transformations to be applied leads to significant complexity.

SUMMARY

The invention aims to improve the situation.

For this purpose, it proposes a method for processing a signal in the form of consecutive blocks of samples, comprising filtering in a transformed domain of sub-bands. In the invention, the method comprises:

- equalization processing applied to a current block in the transformed domain, and
- filtering-adjustment processing applied in the transformed domain to at least one block adjacent to the current block.

"Block" is understood to mean any succession of samples, such as a frame, or a sub-frame in certain types of signal formats.

Thus the invention proposes an improved filtering in the transformed domain. This approach is advantageously not very complex because the processing remains within the domain of the initial transform. One resulting advantage is that it limits audible aliasing components while accurately providing the filtering characteristic initially desired.

In one embodiment, the filtering-adjustment processing is carried out by a matrix applied to said at least one block adjacent to the current block, said matrix comprising upper and lower diagonals that are identical aside from the sign.

In one embodiment, the method then comprises a prior step of optimizing the equalization and filtering-adjustment parameters, by estimating the aliasing resulting from the equalization.

The aliasing is preferably estimated in a domain obtained from an inverse transform of the domain of sub-bands (for example in the time domain).

This estimate in the direct domain more effectively limits the audible distortion caused by aliasing, and therefore provides a more refined optimization of the filtering-adjustment parameters.

Advantageously, the equalization and filtering adjustment in the transformed domain comprise:

equalization processing applied to a current block, filtering-adjustment processing applied to at least one block temporally preceding the current block, and filtering-adjustment processing applied to at least one block temporally following the current block.

Thus, this embodiment proposes relying on both the block preceding and the block immediately following the current block.

In one embodiment, the equalization and filtering-adjustment include the application of a matrix system comprising:

a first matrix applied to a signal vector representing the current block, a second matrix applied to a signal vector representing the preceding block, and a third matrix applied to a signal vector representing the following block.

Advantageously, the third matrix is the transpose of the second matrix.

The invention therefore proposes, in particular, symmetrical structures (for example by filtering in a cosine-modulated filter bank at any critical sampling) which allow obtaining easily performed functions.

In one embodiment, prior to the equalization and adjustment processing and therefore prior to the application of the matrices, the blocks are transformed in the domain of the sub-bands by at least one modulated transform, for example an MDCT transform.

In one sophisticated embodiment, the transform can be a complex-valued modulated transform (for example MCLT or PQMF).

In one embodiment of the invention, in which the current and adjacent blocks are represented by signal vectors, the equalization and filtering-adjustment include the application of a matrix system comprising at least:

a first matrix (To) applied to the signal vector of the current block, and a second matrix ($T_1$) applied to the signal vector of the adjacent block.

The first matrix ($T_0$) applied to the signal vector of the current block comprises as the only non-zero elements a succession of identical elements A, in the diagonal of the matrix, followed by an element A-B for a given sub-band and by an element B for the sub-band which follows the given sub-band, and the second matrix ($T_1$) applied to the signal vector of the adjacent block comprises as the only non-zero elements at least two elements of identical absolute value and of opposite signs, arranged in the diagonal of the matrix, respectively for the given sub-band and for the sub-band which follows the given sub-band.

More generally, the invention allows implementing structures for correcting low-pass, band-pass, or other filters, in the domain of real or complex values, using simple functions as described below.

In one embodiment, the filtering comprises a cutoff component for beyond a sub-band corresponding to said given sub-band.

Advantageously, in the case where a third matrix is involved, the second and third matrices comprise a number of non-zero elements which is a function of the chosen degree of optimization of the filtering-adjustment parameters, minimizing the estimated aliasing.

The invention thus proposes computationally efficient structures with a limited number of coefficients to be added. Better still, it is possible to choose the number of matrix coefficients that must be managed as a function of the desired complexity, or as a function of a compromise between complexity and aliasing limitation.

In one embodiment which allows greatly reducing (even virtually eliminating) the distortion related to aliasing, for a low-pass filtering the first matrix is expressed in the form:

$$T_0 = \begin{pmatrix} 1 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 1 & 0 & 0 & 0 & 0 & 0 & \dots & 0 \\ 0 & \dots & 0 & 1 & 0 & 0 & 0 & 0 & \dots & 0 \\ 0 & \dots & 0 & 0 & 1-a_0 & 0 & 0 & 0 & \dots & 0 \\ 0 & \dots & 0 & 0 & 0 & a_0 & 0 & 0 & \dots & 0 \\ 0 & \dots & 0 & 0 & 0 & 0 & 0 & 0 & \dots & 0 \\ 0 & \dots & 0 & 0 & 0 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix},$$

the coefficient $1-a_0$ being applied for the given sub-band, the second matrix is expressed in the form:

$$T_1 = \begin{pmatrix} 0 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 0 & 0 & 0 & a_5 & 0 & 0 & \dots & 0 \\ 0 & \dots & 0 & 0 & a_3 & 0 & -a_4 & 0 & \dots & 0 \\ 0 & \dots & 0 & -a_3 & -a_1 & -a_2 & 0 & a_5 & \dots & 0 \\ 0 & \dots & -a_5 & 0 & a_2 & a_1 & a_3 & 0 & \dots & 0 \\ 0 & \dots & 0 & a_4 & 0 & -a_3 & 0 & 0 & \dots & 0 \\ 0 & \dots & 0 & 0 & -a_5 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix},$$

the coefficient $-a_1$ of the diagonal being applied for the given sub-band, and the third matrix is the transpose of the second matrix.

In these expressions, the coefficients $a_0$, $a_1$, $a_2$, $a_3$, $a_4$ and as are positive real numbers, with at least the real number $a_1$ being non-zero.

In the case of a linear combination of matrices as described below, the term $a_0$ can be zero for a given matrix, which can be compensated for by another matrix combined with this given matrix.

If all these coefficients are non-zero for a given matrix, an optimal minimization of the aliasing distortion for a low-pass filter gives:

$a_0$=0.2548 $a_1$=0.1249 $a_2$=0.0812 $a_3$=0.0409 $a_4$=0.0192 $a_5$=0.0132

In one embodiment where the filtering to be corrected results from a linear combination of multiple filterings, the matrix correction system of the invention comprises at least:

a corresponding linear combination of first matrices, applied to the signal vector of the current block, a linear combination of second matrices, applied to the signal vector of the preceding block, and a linear combination of third matrices, respective transposes of the second matrices, applied to the signal vector of the following block.

Thus, the approach of the invention can be generalized to any filtering and equalization functions, using filtering-adjustment coefficients adapted from an analysis of the distortion to be corrected.

The invention also concerns a computer program comprising instructions for implementing the above method when this program is executed by a processor. An example flowchart of the general algorithm of such a program is described below in reference to FIG. 13.

The invention also relates to a device for processing a signal in the form of consecutive blocks of samples, comprising means for filtering in a transformed domain of sub-bands. These means additionally apply:

- equalization processing to a current block in the transformed domain, and
- filtering-adjustment processing, in the transformed domain, to at least one block adjacent to the current block.

One example embodiment of such a device is described below in reference to FIG. 14.

BRIEF DESCRIPTION OF THE DRAWINGS

Other features and advantages of the invention will become apparent upon reviewing the following detailed description and the attached drawings, in which:

FIG. 1A schematically illustrates a first processing which carries out a filtering S(z), then a direct transformation followed by an inverse transformation, FIG. 1B schematically illustrates a second processing performing a direct transform, followed by processing in the desired sub-bands $S_{sb}(z)$, and finally performing the inverse transform, FIG. 1B and FIG. 1A distinguishing two approaches of polyphase systems, FIG. 2 schematically illustrates the multiplication of a scalar in each sub-band of the transformed domain in order to represent any filtering, FIG. 3 illustrates the general form of a linear filtering (low-pass filter) applied in matrix form in the transformed domain, FIG. 15 illustrates a table of diagonals, in an example embodiment, FIG. 16 illustrates a table of diagonals, in an example embodiment, FIG. 17 illustrates a table of diagonals, in an example embodiment, FIG. 18 illustrates a table of diagonals, in an example embodiment, FIG. 19 illustrates a table of diagonals, in an example embodiment, and FIG. 20 illustrates a table of diagonals, in an example embodiment.

DETAILED DESCRIPTION

Figure 4:
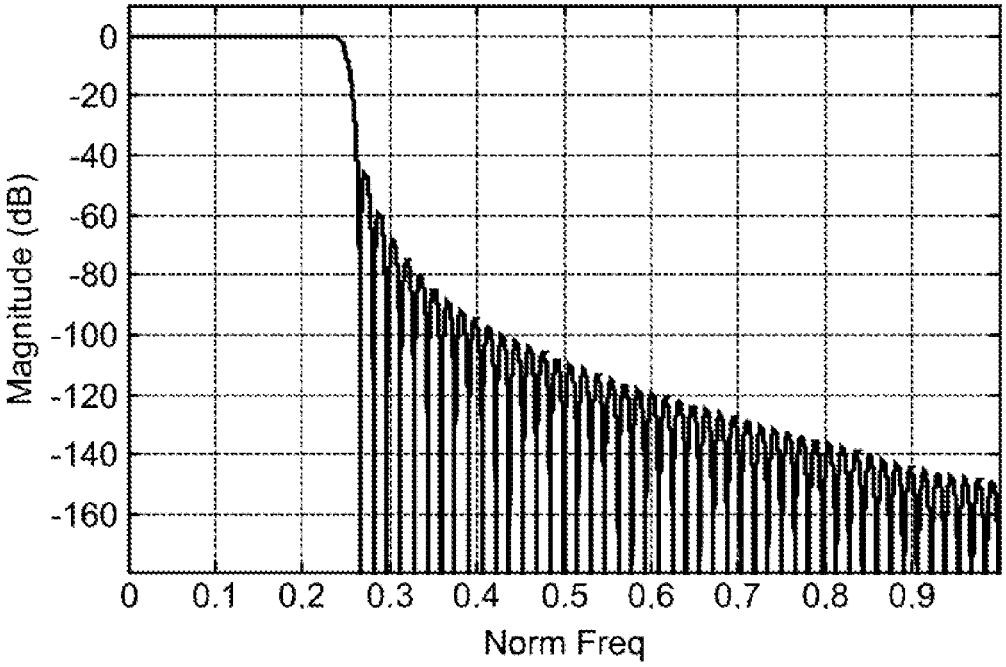
FIG. 4 shows the general form of the frequencies for the filter of FIG. 3.

A few principles of polyphase systems are summarized below. The particular aim here is to measure the effect of a function filtering in sub-bands (transformed domain) in the time domain (after inverse transformation).

For this purpose, we attempt to establish a relation between two processing steps:

- a first processing (a) which performs a filtering S(z), then performs a direct transformation followed by an inverse transformation,
- a second processing (b) which carries out a direct transformation, followed by a processing in desired sub-bands $S_{sb}(z)$, and lastly performing the inverse transformation.

A filtering expression S(z) is then extracted.

The two processing steps are respectively illustrated in FIGS. 1A and 1B.

To simplify the identification of these processing steps, we write the operations performed in the polyphase domain. This is a conventional approach for simplifying the resolution of systems including transforms with sampling.

The analysis filter bank (or the direct transform) is expressed by its polyphase matrix of order M, E(z).

The synthesis filter bank (or inverse transform) is expressed by its polyphase matrix of order M, R(z).

M represents the number of transform coefficients (meaning the number of frequency coefficients obtained by the transform).

The polyphase decomposition of the modulated transforms, including the MDCT transform, is expressed by:

$$H_k(z) = \sum_{l=0}^{M-1} z^{-1} E_{k,l}(z^M)$$

The polyphase components of the transforms are written as follows, based on the impulse responses of the analysis filters $h_{a,k,n}$ for sub-band k and coefficient n. This example is limited, without limiting its generality however, to a transform in which the impulse responses have a length 2M, such as the MDCT transform.

$$E(z)=\begin{bmatrix} E_{0,0}(z) & E_{0,1}(z) & \dots & E_{0,M-1}(z) \\ E_{1,0}(z) & E_{1,1}(z) & \dots & E_{1,M-1}(z) \\ \vdots & \vdots & \ddots & \vdots \\ E_{0,M-1}(z) & E_{1,M-1}(z) & \dots & E_{M-1,M-1}(z) \end{bmatrix}$$

$$=\begin{bmatrix} h_{a,0,0}+z^{-1}h_{a,0,M} & h_{a,0,1}+z^{-1}h_{a,0,M+1} & \dots & h_{a,0,M-1}+z^{-1}h_{a,0,2M-1} \\ h_{a,1,0}+z^{-1}h_{a,1,M} & h_{a,1,1}+z^{-1}h_{a,1,M+1} & \dots & h_{a,1,M-1}+z^{-1}h_{a,1,2M-1} \\ \vdots & \vdots & \ddots & \vdots \\ h_{a,M-1,0}+z^{-1}h_{a,M-1,M} & h_{M-1,1}+z^{-1}h_{M-1,M+1} & \dots & h_{a,M-1,M-1}+z^{-1}h_{a,M-1,2M-1} \end{bmatrix}$$

$$=\begin{bmatrix} h_{a,0,0} & h_{a,0,1} & \dots & h_{a,0,M-1} \\ h_{a,1,0} & h_{a,1,1} & \dots & h_{a,1,M-1} \\ \vdots & \vdots & \ddots & \vdots \\ h_{a,M-1,0} & h_{a,M-1,1} & \dots & h_{a,M-1,M-1} \end{bmatrix}+$$

$$z^{-1}\begin{bmatrix} h_{a,0,M} & h_{a,0,M+1} & \dots & h_{a,0,2M-1} \\ h_{a,1,M} & h_{a,1,M+1} & \dots & h_{a,1,2M-1} \\ \vdots & \vdots & \ddots & \vdots \\ h_{a,M-1,M} & h_{a,M-1,M+1} & \dots & h_{a,M-1,2M-1} \end{bmatrix}$$

Then the modulations $c_{k,n}$ and the analysis prototype filter $h_{a,n}$ are introduced for a modulated transform, where:

$$c_{k,n}=\cos\left(\frac{\pi}{M}\left(n+\frac{1+M}{2}\right)\left(k+\frac{1}{2}\right)\right),$$

where $$0\le n<2M,\ 0\le k<M$$

and $h_{a,n}$ is an analysis prototype filter (or window) containing 2M samples, some of them possibly being zero (particularly those with the highest indices).

$$E(z)=\begin{bmatrix} c_{0,0} & c_{0,1} & \dots & c_{0,M-1} \\ c_{1,0} & c_{1,1} & \dots & c_{1,M-1} \\ \vdots & \vdots & \ddots & \vdots \\ c_{M-1,0} & c_{M-1,1} & \dots & c_{M-1,M-1} \end{bmatrix}\begin{bmatrix} h_{a,0} & 0 & \dots & 0 \\ 0 & h_{a,1} & \dots & 0 \\ \vdots & \vdots & \ddots & \vdots \\ 0 & 0 & \dots & h_{a,M-1} \end{bmatrix}+$$

$$z^{-1}\begin{bmatrix} c_{0,M} & c_{0,M+1} & \dots & c_{0,2M-1} \\ c_{1,M} & c_{1,M+1} & \dots & c_{1,2M-1} \\ \vdots & \vdots & \ddots & \vdots \\ c_{M-1,M} & c_{M-1,M+1} & \dots & c_{M-1,2M-1} \end{bmatrix}\begin{bmatrix} h_{a,M} & 0 & \dots & 0 \\ 0 & h_{a,M+1} & \dots & 0 \\ \vdots & \vdots & \ddots & \vdots \\ 0 & 0 & \dots & h_{a,2M-1} \end{bmatrix}$$

By introducing the notations:

$$C_0=\begin{bmatrix} c_{0,0} & c_{0,1} & \dots & c_{0,M-1} \\ c_{1,0} & c_{1,1} & \dots & c_{1,M-1} \\ \vdots & \vdots & \ddots & \vdots \\ c_{M-1,0} & c_{M-1,1} & \dots & c_{M-1,M-1} \end{bmatrix}$$

$$C_M=\begin{bmatrix} c_{0,M} & c_{0,M+1} & \dots & c_{0,2M-1} \\ c_{1,M} & c_{1,M+1} & \dots & c_{1,2M-1} \\ \vdots & \vdots & \ddots & \vdots \\ c_{M-1,M} & c_{M-1,M+1} & \dots & c_{M-1,2M-1} \end{bmatrix}$$

-continued $$h_{a,0}=\begin{bmatrix} h_{a,0} & 0 & \dots & 0 \\ 0 & h_{a,1} & \dots & 0 \\ \vdots & \vdots & \ddots & \vdots \\ 0 & 0 & \dots & h_{a,M-1} \end{bmatrix}$$

$$h_{a,1}=\begin{bmatrix} h_{a,M} & 0 & \dots & 0 \\ 0 & h_{a,M+1} & \dots & 0 \\ \vdots & \vdots & \ddots & \vdots \\ 0 & 0 & \dots & h_{a,2M-1} \end{bmatrix},$$

we obtain:

$$E(z)=C_0h_{a,0}+z^{-1}C_1h_{a,1}$$

For synthesis, reciprocally we obtain:

$$R(z)=h_{s,0}C'_1+z^{-1}h_{s,1}C'_0,$$

Below, the symbol ' indicates the transposition of a matrix.

The filter $h_{s,n}$ here is a prototype filter (called the synthesis window) containing 2M samples, some of which may possibly be zero (particularly those with the lowest indices).

For the case of the MDCT transform, the reconstruction is perfect to the extent that the modulations and the analysis and synthesis filters meet the following conditions:

$$\begin{aligned} P(z) &= R(z)E(z) \\ &= (h_{s,0}C'_1+z^{-1}h_{s,1}C'_0)(C_0h_{a,0}+z^{-1}C_1h_{a,1}) \\ &= h_{s,0}C'_1C_0h_{a,0}+z^{-1}[h_{s,0}C'_1C_1h_{a,1}+h_{s,1}C'_0C_0h_{a,0}]+ \\ &\quad z^{-2}h_{s,1}C'_0C_1h_{a,1} \end{aligned}$$

implying the two conditions:

$$C'_1C_0=C'_0C_1=0$$

and $h_{s,0}C'_1C_1+h_{a,1}+h_{s,1}C'_0C_0h_{a,0}=I_M$ (carefully choosing $h_{a,n}$ and $h_{s,n}$), $I_M$ being the identity matrix of size M×M. Thus:

$$P(z)=R(z)E(z)=z^{-1}I_M$$

The MDCT transform is therefore a perfect reconstruction (at the cost of a delay of one frame, i.e. M samples, in the case of a signal containing a succession of frames of M samples each).

A corollary to the complete reconstruction of the MDCT transform implies that:

$$R^{-1}(z)R(z)E(z)=z^{-1}R^{-1}(z)$$

This reveals a useful property for the following:

$$R^{-1}(z)=zE(z) \tag{0.1}$$

Next we will describe the influence, in terms of aliasing, of a filtering equalization operation in the transformed domain. This influence is analyzed in the time domain after inverse transform.

It begins with processing in sub-bands $S_{sb}(z)$ and it attempts to estimate the resulting filtering function S(z). As the processing is expressed in the polyphase domain, the notations $S_{sb}(z)$ and S(z) concern filter matrices. It should be noted that S(z) does not necessarily represent a linear filter that can be implemented as a convolution.

Starting with identifying the processing steps (a) and (b):

$$Y(z)=R(z)S_{sb}(z)E(z)X(z)=S(z)R(z)E(z)X(z)$$

$$R(z)S_{sb}(z)=S(z)R(z)$$

and then multiplying the two sides by $R^{-1}(z)$:

$$R(z)S_{sb}(z)R^{-1}(z)=S(z)R(z)R^{-1}(z)$$

we obtain (where $R^{-1}(z)=zE(z)$, as shown above):

$$R(z)S_{sb}(z)zE(z)=S(z)$$

$$S(z)=zR(z)S_{sb}(z)E(z) \tag{0.2}$$

By replacing R and E with their expression, which depends on the filter bank used, the matrix S(z) can then be calculated.

The elements of this matrix are indexed as follows:

$$S(z)=\begin{bmatrix} S_{0,0}(z) & S_{0,1}(z) & S_{0,2}(z) & \dots & S_{0,M-2}(z) & S_{0,M-1}(z) \\ S_{1,0}(z) & S_{1,1}(z) & S_{1,2}(z) & \dots & S_{1,M-2}(z) & S_{1,M-1}(z) \\ S_{2,0}(z) & S_{2,1}(z) & S_{2,2}(z) & \dots & S_{2,M-2}(z) & S_{2,M-1}(z) \\ \vdots & \vdots & \vdots & \ddots & \vdots & \vdots \\ S_{M-2,0}(z) & S_{M-2,1}(z) & S_{M-2,2}(z) & \dots & S_{M-2,M-2}(z) & S_{M-2,M-1}(z) \\ S_{M-1,0}(z) & S_{M-1,1}(z) & S_{M-1,2}(z) & \dots & S_{M-1,M-2}(z) & S_{M-1,M-1}(z) \end{bmatrix}$$

This matrix decomposes into:

$S(z)=S_{lin}(z)+S_{alias}(z)$, where:

$S_{lin}(z)$ is a filtering matrix in the following circular form (guaranteeing the fact that it corresponds to a linear filter in the form of a convolution):

$$S_{lin}(z)=\begin{bmatrix} S_{lin,0}(z) & S_{lin,1}(z) & S_{lin,2}(z) & & \dots & S_{lin,M-1}(z) \\ z^{-1}S_{lin,M-1}(z) & S_{lin,0}(z) & S_{lin,1}(z) & & \dots & S_{lin,M-2}(z) \\ z^{-1}S_{lin,M-2}(z) & z^{-1}S_{lin,M-1}(z) & S_{lin,0}(z) & & \dots & S_{lin,M-3}(z) \\ \vdots & \vdots & \vdots & & \ddots & \vdots \\ z^{-1}S_{lin,1}(z) & z^{-1}S_{lin,2}(z) & \dots & z^{-1}S_{lin,M-1}(z) & & S_{lin,0}(z) \end{bmatrix}$$

the coefficients of the linear filter being written as:

$$S_{lin}(z)=\sum_n s_{lin,n}z^{-n}=\sum_{l=0}^{M-1} z^{-1}S_{lin,l}(z^M),$$

and $S_{alias}(z)$ is any filtering matrix which represents components corresponding to aliasing due to signal inversion on the time and/or frequency axis and creating additional associated components.

For the estimation of the linear portion $S_{lin}(z)$, a least squares estimation is preferably used, minimizing the power of the term $S_{alias}(z)$. This is in order to observe the primary contribution of linear filtering present in the matrix $S_{sb}(z)$.

This seeks to minimize an expression of the type:

$$\|S_{alias}(z)\|^2=\|S(z)-S_{lin}(z)\|^2$$

The terms of the matrix $S_{lin}(z)$ can be calculated by estimating the mean of the diagonal terms of the matrix S (z), as follows:

$$S_{lin,0}(z)=\frac{1}{M}\left[\sum_{k=0}^{M-1} S_{k,k}(z)\right] \text{ and}$$

$$S_{lin,m}(z)=\frac{1}{M}\left[\sum_{k=0}^{M-1-m} S_{k,k+m}(z)+z\sum_{k=0}^{m-1} S_{M+k-m,k}(z)\right]$$

for indices $0<m\leq M-1$

The corresponding linear filter is estimated by the expression:

$$S_{lin}(z)=\sum_{l=0}^{M-1} z^{-l}S_{lin,l}(z^M)$$

The aliasing component, which contains the filters with non-linear components, is calculated by the difference of the two matrices:

$$S_{alias}(z)=S(z)-S_{lin}(z)$$

The power of this matrix is deduced from this by summing the square of the coefficients of this matrix, in order to estimate the amount of aliasing created.

To summarize, after an operation is performed in the transformed domain (particularly equalization), the effect of this operation is assessed after inverse transformation:

with decomposition into two parts:

a linear part, representing a linear filter (corresponding to a conventional filtering function in signal processing); this filtering has the effect of modifying the spectrum of the signal by attenuating or amplifying the signal in certain frequencies, and a non-linear part which contains aliasing components considered to be undesirable, and a measurement of the power of these undesirable components.

Thus, it is possible by this implementation:

to measure the distortion introduced by the prior art solutions when they apply an equalization in the transformed domain, to propose sub-band filtering structures which allow reducing the measured distortions.

We will now describe example embodiments of the invention which use a measurement of this type.

In one example embodiment, we propose studying the transfer function obtained in the time domain, after multiplication of MDCT components. One example of such multiplication is the application of a multiplication by a scalar $T_k$ of each component issuing from the MDCT transformation, as illustrated in FIG. 2. Such processing by multiplying each component $T_k$ is called equalization.

An example of a feasible filtering function is the following:

$T_k=1$ for $0\leq k<M/4$, and $T_k=0$ for $M/4\leq k<M$, which is the same as writing:

$$S_{sb}(z)=\begin{pmatrix} 1 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 1 & 0 & 0 & 0 & 0 & 0 & \dots & 0 \\ 0 & \dots & 0 & 1 & 0 & 0 & 0 & 0 & \dots & 0 \\ 0 & \dots & 0 & 0 & 1 & 0 & 0 & 0 & \dots & 0 \\ 0 & \dots & 0 & 0 & 0 & 0 & 0 & 0 & \dots & 0 \\ 0 & \dots & 0 & 0 & 0 & 0 & 0 & 0 & \dots & 0 \\ 0 & \dots & 0 & 0 & 0 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix}$$

For the transformation, an MDCT transform of size M=64 is used in this example, with a sinusoidal window (referred to as a "Malvar" window) for the prototype filter, in both the analysis and the synthesis.

After estimating the linear part in the time domain, a linear filter is obtained as represented in FIG. 3. This is a low-pass filter, as shown in FIG. 4.

By estimating the aliasing power as indicated above, a power of −24.69 dB is measured, which can create undesirable audio effects.

Modifying the sub-band filtering matrix is then proposed, configuring it as follows:

$$\hat{S}_{sb}(z)=\begin{pmatrix} 1 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 1 & 0 & 0 & 0 & 0 & 0 & \dots & 0 \\ 0 & \dots & 0 & 1 & 0 & 0 & 0 & 0 & \dots & 0 \\ 0 & \dots & 0 & 0 & 1-a_0 & 0 & 0 & 0 & \dots & 0 \\ 0 & \dots & 0 & 0 & 0 & a_0 & 0 & 0 & \dots & 0 \\ 0 & \dots & 0 & 0 & 0 & 0 & 0 & 0 & \dots & 0 \\ 0 & \dots & 0 & 0 & 0 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix}$$

The position of coefficient $1-a_0$ (row i, column i) corresponds to that of the last coefficient at "1" in the uncorrected filtering matrix of the conventional low-pass filter, and the position of coefficient $a_0$ corresponds to row i+1, column i+1.

Figure 5:
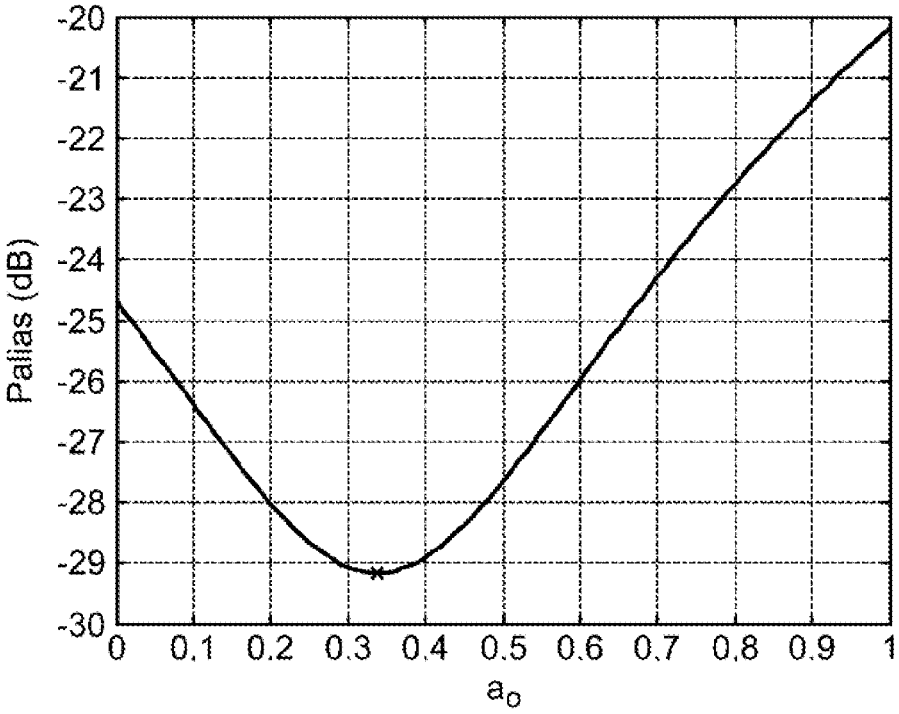
FIG. 5 represents the distortion (ordinates), reduced by optimization of the equalization parameter $a_0$ (abscissas), in an embodiment without filtering adjustment.

Advantageously, the evolution in the aliasing distortion is measured while varying the parameter $a_0$. This distortion is represented (ordinates) as a function of the parameter $a_0$ (abscissas) in FIG. 5, in which there is a minimum at $a_0=0.3379$.

The distortion is then lowered to −29.16 dB, which is an improvement of 4.47 dB relative to the current situation (the prior art).

Figure 6:
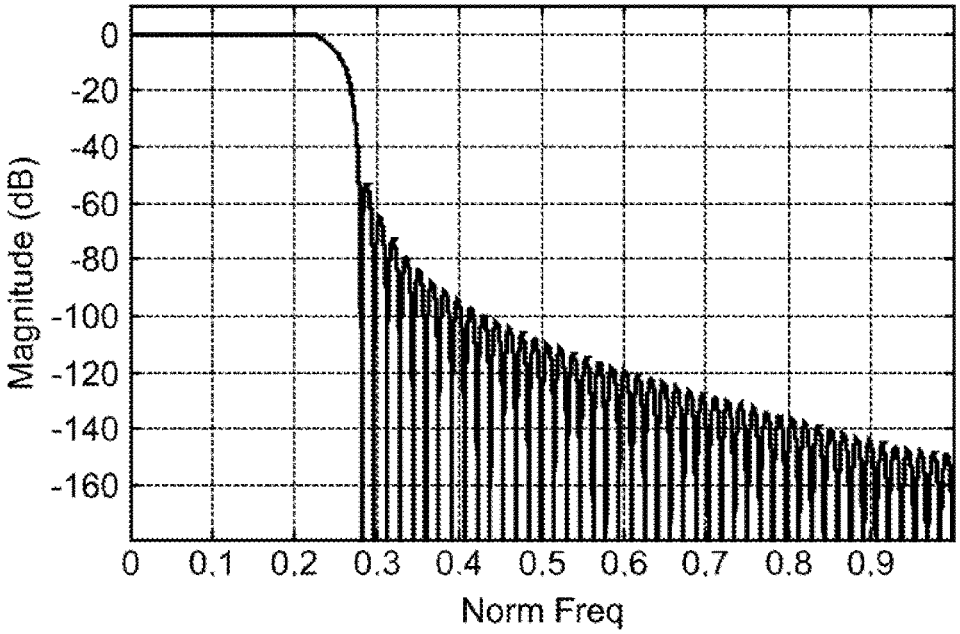
FIG. 6 represents the frequency characteristics of the filter resulting from the equalization optimization illustrated in FIG. 5.

Advantageously, the filter resulting from this modification also has characteristics close to those of the initial desired filter, as illustrated in FIG. 6.

Lastly, an equalization processing is applied with adapted coefficients $a_0$ and $1-a_0$ obtained by determining the aliasing power (distortion variation) as a function of the coefficient $a_0$.

Thus, by observing the aliasing components created by the sub-band filtering matrix $S_{sb}$, it is apparent that these aliasing components can be reduced by adding anti-aliasing filtering components $1-a_0$ and $a_0$ to this matrix.

In the invention, this approach can be further extended by attempting a correction of the aliasing effect in the time domain. Here we are interested not only in the signal to be processed within a given frame for the equalization described above, but are also interested in the signal of the frame preceding and/or following this given frame. Still in this example embodiment of an MDCT transform, a first matrix $T_1$ to be applied to the preceding frame (in the form of a signal vector) is proposed, and, due to the symmetry of this type of transform, a second matrix $T'_1$ is proposed which is deduced from the first matrix $T_1$, to be applied to the following frame. Here, the second matrix $T'_1$ corresponds in particular to the transpose of the first matrix $T_1$.

The expression for such general processing is expressed as follows:

$\hat{S}_{sb}(z)=T_1z^{-1}+T_0+T'_1z$, where $T'_1$ is the transpose of the matrix $T_1$, the notations $z^{-1}$ and z respectively referring to the preceding frame and the following frame.

This looks for the form, in this case for a low-pass filtering with equalization in the transformed domain, that this matrix $T_1$ can take and that would minimize the aliasing (measured in "aliasing power" as indicated above). Firstly, it looks for a simple expression of the matrix $T_1$ which only contains non-zero elements in its main diagonal, to limit the complexity of the processing. After estimating the aliasing, it is apparent that this matrix $T_1$ has zero elements everywhere except at the positions of the coefficients $1-a_0$ and $a_0$ of the matrix $T_0$. The coefficients of the matrix $T_1$ occupying these positions are respectively $-a_1$ and $a_1$ types. In this case, of course, the transpose matrix $T'_1$ is identical.

This implementation already advantageously reduces the distortion by several dB compared to the simple equalization based solely on the matrix $T_0$. A level of distortion lowered to −32.71 dB is obtained, which is an improvement of 8 dB over the prior art situation, with optimized coefficients:

$$a_0=0.2845 \text{ and } a_1=0.1311.$$

A filtering function is therefore performed on the consecutive spectra $x_{-1,k}$, $x_{0,k}$ and $x_{1,k}$ according to the frequency components k, as follows:

$$y_{0,k}=x_{0,k}, \text{ if } k<i$$

$$y_{0,i}=(1-a_0)x_{0,i}-a_1x_{-1,i}-a_1x_{+1,i}$$

$$y_{0,i+1}=a_0x_{0,i+1}+a_1x_{-1,i+1}-a_1x_{+1,i+1}$$

$$\text{and } y_{0,k}=0, \text{ if } k>i+1$$

It is understood that a matrix expression of the filtering adjustment is not necessarily used in this simple embodiment.

It is then possible to reduce the distortion further by enriching the form of the matrix $T_1$ (while increasing the complexity of the calculations, however) and to add other non-zero terms neighboring the coefficients $-a_1$ and $a_1$. In the example described below, 14 non-zero coefficients are obtained in the matrix $T_1$ and its general distortion-minimizing form is then of the type:

$$T_1 = \begin{pmatrix} 0 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 0 & 0 & 0 & a_5 & 0 & 0 & \dots & 0 \\ 0 & \dots & 0 & 0 & a_3 & 0 & -a_4 & 0 & \dots & 0 \\ 0 & \dots & 0 & -a_3 & -a_1 & -a_2 & 0 & a_5 & \dots & 0 \\ 0 & \dots & -a_5 & 0 & a_2 & a_1 & a_3 & 0 & \dots & 0 \\ 0 & \dots & 0 & a_4 & 0 & -a_3 & 0 & 0 & \dots & 0 \\ 0 & \dots & 0 & 0 & -a_5 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix}$$

The matrix system for this comprehensive processing is then written:

$$\hat{S}_{sb}(z) = z^{-1}\begin{pmatrix} 0 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 0 & 0 & 0 & a_5 & 0 & 0 & \dots & 0 \\ 0 & \dots & 0 & 0 & a_3 & 0 & -a_4 & 0 & \dots & 0 \\ 0 & \dots & 0 & -a_3 & -a_1 & -a_2 & 0 & a_5 & \dots & 0 \\ 0 & \dots & -a_5 & 0 & a_2 & a_1 & a_3 & 0 & \dots & 0 \\ 0 & \dots & 0 & a_4 & 0 & -a_3 & 0 & 0 & \dots & 0 \\ 0 & \dots & 0 & 0 & -a_5 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix} +$$

$$\begin{pmatrix} 1 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 1 & 0 & 0 & 0 & 0 & 0 & \dots & 0 \\ 0 & \dots & 0 & 1 & 0 & 0 & 0 & 0 & \dots & 0 \\ 0 & \dots & 0 & 0 & 1-a_0 & 0 & 0 & 0 & \dots & 0 \\ 0 & \dots & 0 & 0 & 0 & a_0 & 0 & 0 & \dots & 0 \\ 0 & \dots & 0 & 0 & 0 & 0 & 0 & 0 & \dots & 0 \\ 0 & \dots & 0 & 0 & 0 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix} +$$

$$z^{+1}\begin{pmatrix} 0 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 0 & 0 & 0 & -a_5 & 0 & 0 & \dots & 0 \\ 0 & \dots & 0 & 0 & -a_3 & 0 & a_4 & 0 & \dots & 0 \\ 0 & \dots & 0 & a_3 & -a_1 & a_2 & 0 & -a_5 & \dots & 0 \\ 0 & \dots & a_5 & 0 & -a_2 & a_1 & -a_3 & 0 & \dots & 0 \\ 0 & \dots & 0 & -a_4 & 0 & a_3 & 0 & 0 & \dots & 0 \\ 0 & \dots & 0 & 0 & a_5 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix}$$

In a simplified form, we have:

$\hat{S}_{sb}(z)=T_1z^{-1}+T_0+T'_1z$, $T'_1$ being the transpose of the matrix $T_1$, which corresponds to:

- applying the matrix $T_0$, corrected for equalization, to a current frame in the transformed domain,
- applying the matrix $T_1$ to a transformed signal, calculated from the signal using M samples preceding the one used for the matrix $T_0$, therefore ultimately in the frame of samples preceding a current frame which is itself processed by the matrix $T_0$,
- and applying the matrix $T_1'$ to a transformed signal, calculated from the signal using M samples following the one used for the matrix $T_0$, therefore ultimately in the frame of samples which succeeds the current frame.

It is thus understood that the matrices $T_1$, $T_0$ and $T_1'$ are respectively applied to three successive frames of an MDCT transform.

The task of the matrix $T_1$ is therefore to reduce the level of aliasing introduced by the matrix $T_0$ which implements an equalization function.

In the expression of the above matrices, all the elements are therefore zero, aside from:

- a few elements in the main diagonal of matrix $T_0$ and matrix $T_1$, and
- elements of the first and third upper diagonal of matrix $T_1$ and of the first and third lower diagonal of matrix $T_1$.

Recall that matrix $T'_1$ is the transpose of matrix $T_1$.

The filtering matrix, in this example embodiment of the invention, is therefore described perfectly by the following diagonal elements:

diag(T0,0)
diag(T1,0)
diag(T1,−1)
diag(T1,−3)
diag(T1,+1)
diag(T1,+3)

Note that the upper and lower diagonals are identical aside from the sign:

diag(T1,−1)=−diag(T1,+1)
diag(T1,−3)=−diag(T1,+3)

A more compact form is obtained by writing only the diagonals, as shown in FIG. 15.

By minimizing the aliasing error as a function of the free variables $a_0$ to $a_5$, an aliasing power corresponding to −45.31 dB is obtained, which is a gain of 20.6 dB relative to the prior art. In this numerical example, a good choice of coefficients is the following:

$$a_0=0.2548\ a_1=0.1249\ a_2=0.0812\ a_3=0.0409$$
$$a_4=0.0192\ a_5=0.0132$$

One will note here that the values of these coefficients a, decrease with the index i, which means that in order to reduce, for example, the number of coefficients a, to be considered (for example to reduce processing complexity), it is sufficient to:

- set coefficient as to 0
- and, possibly to reduce the complexity further, set coefficient $a_4$ to 0,
- etc.

The coefficients remaining non-zero, $a_0$, $a_1$, $a_2$, etc., are optionally adjusted to reduce distortion.

A set of coefficients $a_0, \dots, a_i$ can thus be calculated for each value of i from 1 to n (with a maximum of n=5 for example), so as to choose a set of coefficients $a_0, \dots, a_i$ adapted for a given situation (for example in terms of processing complexity in a terminal or other equipment in a telecommunications network).

Figure 7:
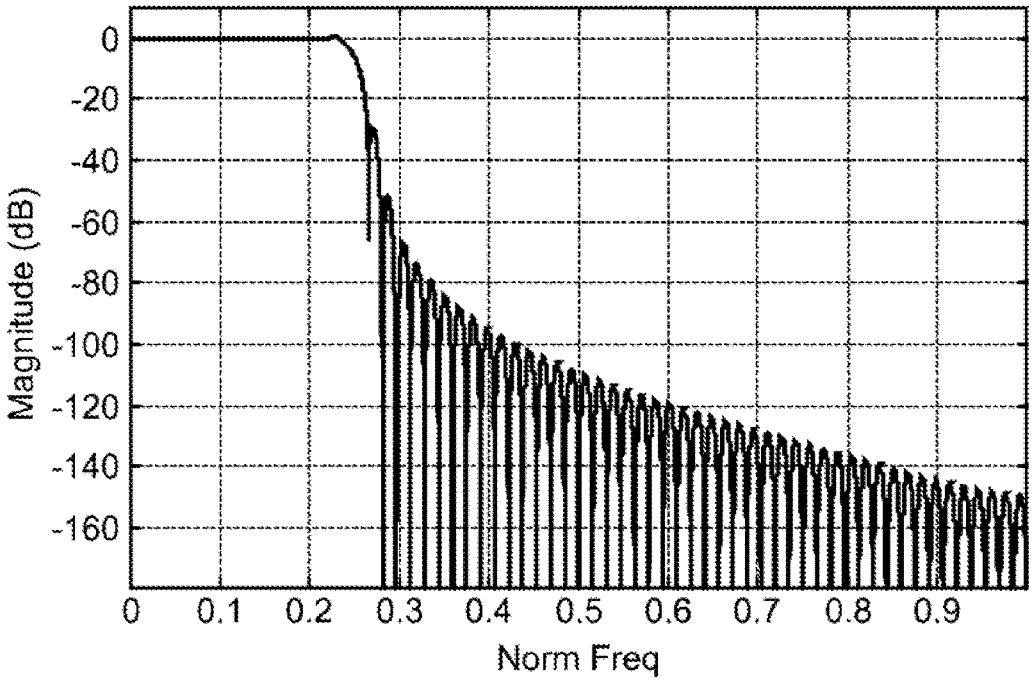
FIG. 7 represents the frequency characteristics of the filter resulting from the equalization and filtering-adjustment optimization.

It is evident that the resulting linear filter is always very close to the desired function, as is shown in FIG. 7 which illustrates a low-pass filter of very similar characteristics. It is understood in particular that the contents of the diagonal of the matrix $T_0$ applied to the current frame ultimately set the desired frequency range.

The representation can be "degraded" by increasing the number of zero coefficients, for example by forcing $a_5$ to zero. In this case, the optimal sub-band filtering solution introduces a level of aliasing of −42.90 dB (instead of −45.31 dB).

Figure 8:
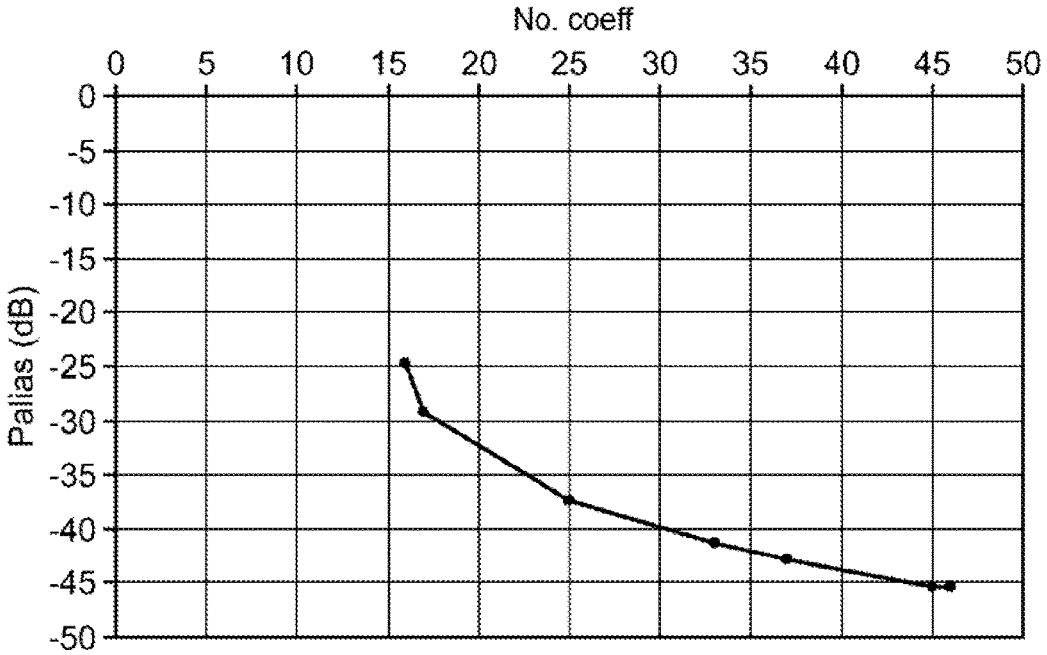
FIG. 8 represents the reduction in the distortion observed due to aliasing (ordinates) as a function of the number of coefficients involved in the equalization and filtering-adjustment (abscissas)

An embodiment is represented in FIG. 8 in which, while the prior art recommends the use of 16 "conventional" coefficients, it proposes adding between 1 and 29 non-zero coefficients (thus with the choice of a set of six basic coefficients $a_o$, $a_1$, . . . , $a_5$) to obtain a reduction in spectral aliasing power ranging from 4.47 to 20.6 dB. The example of adding 29 non-zero coefficients to matrices $T_1$, $T_0$ and $T_1'$ corresponds to adding:

- the coefficient $a_0$ to matrix $T_0$,
- 14 non-zero coefficients, presented above, to matrix $T_1$, and
- 14 corresponding non-zero coefficients to transpose matrix $T'_1$.

It is demonstrated below that the case of a low-pass filter can be transposed to any form of filter, for example a band-pass filter.

One embodiment of the invention is described below in a context of implementing a band-pass filter. A filter is then used for the equalization, in the form:

$$T_k=0 \text{ for } 0\leq k<M/8$$

$$T_k=1 \text{ for } M/8\leq k<M/4$$

$$T_k=0 \text{ for } M/4\leq k<M$$

Figure 9:
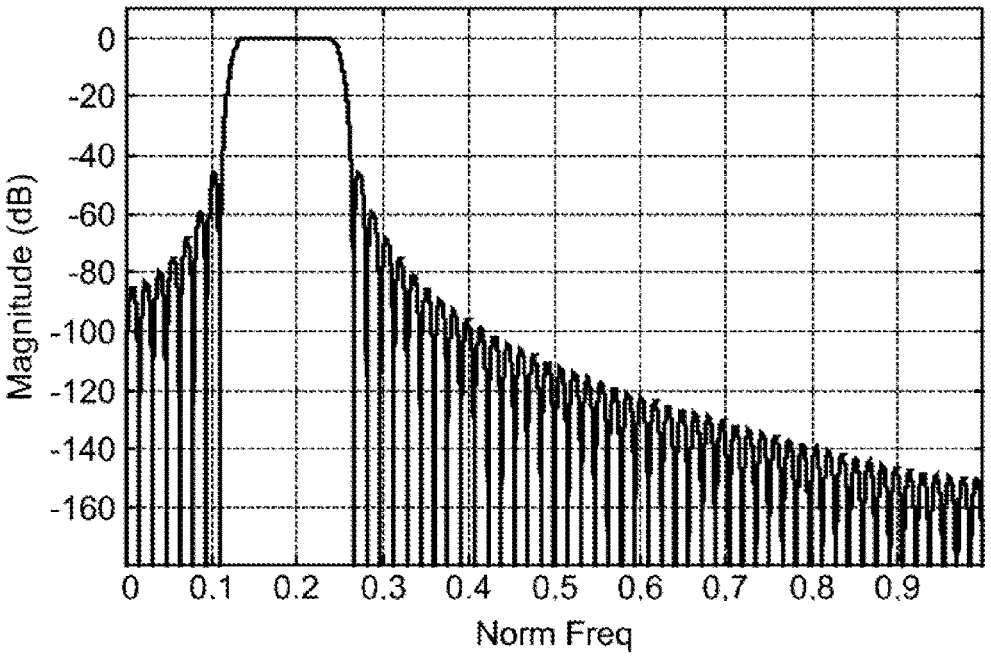
FIG. 9 illustrates the function of filtering, equalization, and filtering adjustment, performed using a set of coefficients $a_0$, $a_1$, $a_2$, $a_3$, $a_4$, $a_5$, in the case of a band-pass filter.

The filtering function performed is illustrated in FIG. 9 and the level of aliasing distortion corresponds to −21.68 dB.

Using the same format as the embodiment presented above for a low-pass filter, two matrices are used to lower the level of aliasing introduced by the band-pass function, by applying:

$$\hat{S}_{sb}(z)=T_1z^{-1}+T_0+T'_1z$$

Only certain diagonals of matrices $T_0$ and $T_1$ are non-zero. Their values are in the form shown in FIG. 16.

The anti-aliasing functions of the low-pass structure are therefore replicated in this new embodiment.

By looking for the best values for the coefficients $a_n$, the amount of aliasing is significantly reduced.

By retaining the values obtained in the embodiment involving a low-pass filter, the level of aliasing is reduced to −42.59 dB which is an improvement of 20.91 dB in comparison to the filtering function presented above (which presents a distortion of −21.68 dB).

An embodiment applied to complex-valued filter banks is now presented.

One example embodiment concerns MCLT (for Modulated Complex Lapped Transform) transforms, described for example in:

H. Malvar, "A Modulated Complex Lapped Transform And Its Applications to Audio Processing". *Proc. International Conference on Acoustics, Speech and Signal Processing,* 1999.

Figure 10:
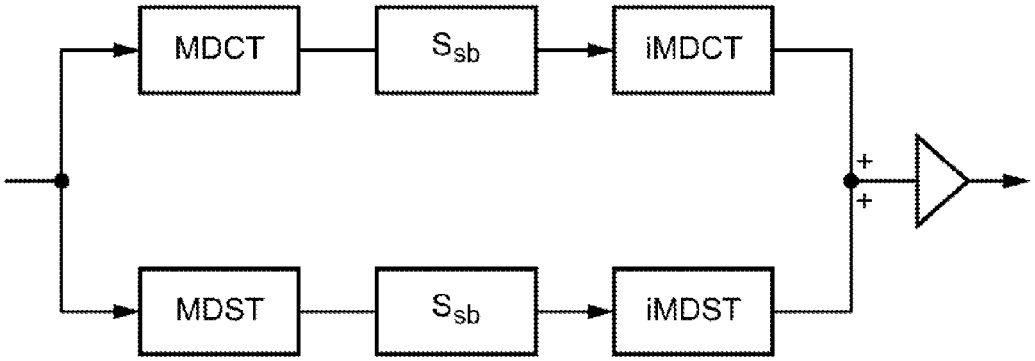
FIG. 10 illustrates the case of a complex-valued modulated transform (MCLT type), FIG. 11 compares the distortion reduction observed due to aliasing (ordinates) as a function of the number of coefficients involved in the equalization and filtering adjustment (abscissas), for a real-valued transform (MDCT, solid line) and for a complex-valued transform (MCLT, dotted lines), for a low-pass filtering, FIG. 12 compares the distortion reduction observed due to aliasing (ordinates) as a function of the number of coefficients involved in the equalization and filtering adjustment (abscissas) for a real-valued transform (MDCT, solid line) and for a complex-valued transform (MCLT, dotted lines), for a band-pass filtering, FIG. 13 summarizes the steps of a method according to the invention, in an example embodiment, FIG. 14 schematically illustrates a device for implementing the invention, in an example embodiment.

With reference to FIG. 10, an MCLT transform consists of two components:

- a component corresponding to the MDCT transform of the signal, identical to the above embodiments, and
- a component corresponding to an MDST (for Modified Discrete Sine Transform) transform of the signal: the cosine terms of the MDCT transform are replaced with sine terms in order to obtain its expression.

A cosine portion of the analysis is then written as follows (identical to the case set forth above):

$$E_c(z)=C_0h_{a,0}+z^{-1}C_1h_{a,1}$$

and a second, sine portion as follows:

$$E_S(z)=S_0h_{a,0}+z_{-1}S_1h_{a,1}$$

The inverse transformations are written in a similar manner:

$$R_c(z)=h_{s,0}C'_1+z^{-1}h_{s,1}C'_0 \text{ et } R_s(z)=h_{s,0}S'_1+z^{-1}h_{s,1}S'_0$$

The matrices $S_i$ contain the sine terms:

$$s_{k,n} = \sin\left(\frac{\pi}{M}\left(n+\frac{1+M}{2}\right)\left(k+\frac{1}{2}\right)\right),\ 0\leq n<2M,\ 0\leq k<M$$

The MCLT transform therefore involves carrying out two direct transforms:

one MDCT transform, and the other an MDST transform, then performing two corresponding inverse transformations, of which the result is summed (with a gain).

The effect of a sub-band processing can ultimately be expressed as:

$$S(z)=\frac{1}{2}(R_c(z)S_b(z)E_c(z)+R_s(z)S_b(z)E_s(z))$$

and the type of processing presented in the above example embodiments is applied:

- in order to provide parameters for the processing in sub-bands $S_{sb}$
- and in order to estimate the linear convolution component and the amount of aliasing introduced.

Thus it is possible simply to apply the results presented in the above examples for the case of the MDCT transform. The matrix $S_{sb}$ configured as above is used, and the distortion characteristic as a function of the number of coefficients can be deduced in the same manner.

Figure 11:
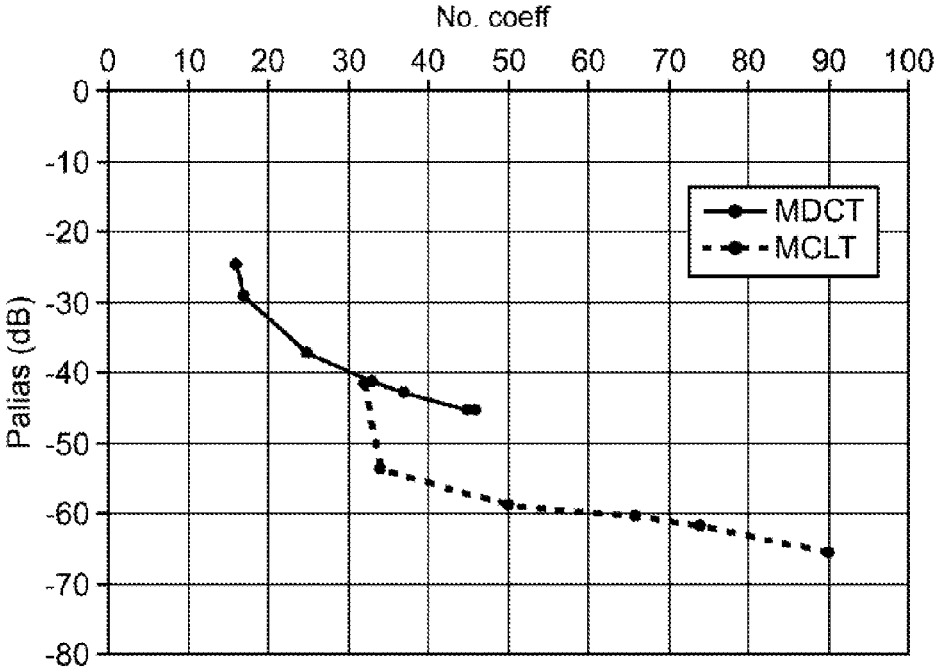
Figure 12:
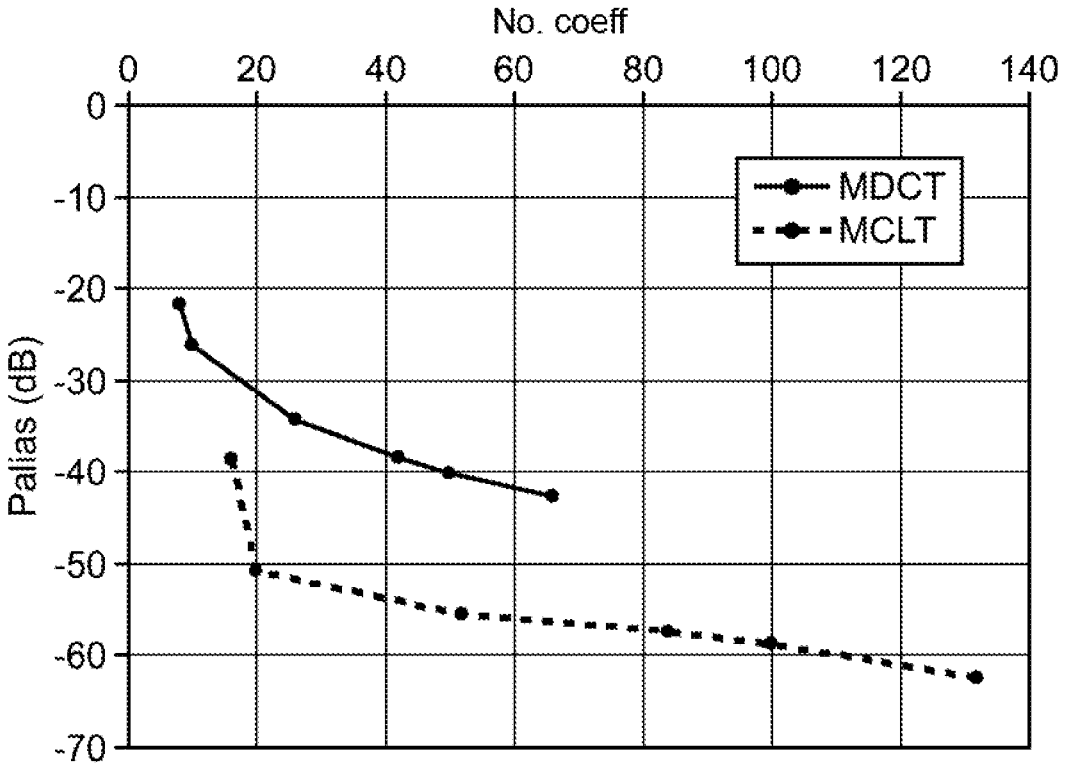

It should be noted that in the case of the MCLT transform, the filtering matrix $S_{sb}$ has the same number of coefficients as for the MDCT transform. However, due to a double application to both the cosine part and the sine part, the total number of coefficients to be applied is doubled, as illustrated in FIG. 11 (for a low-pass filter) and FIG. 12 (for a band-pass filter), which compare the number of coefficients allowing a reduction of the aliasing effect for an MDCT transform (solid line) and for an MCLT transform (dotted lines).

An implementation for any filtering is now described. The filtering functions presented in the above embodiments can be combined. For example, the case presented above for a band-pass filter can be combined with that of a low-pass filter (without restriction).

For example, the form of the resulting filter can be as follows:

low-pass filter for k from 0 to M/8, and band-pass filter for k from M/8 to M/4.

This simply accumulates the contributions from the two filters. The two tables corresponding to the band-pass and low-pass contributions are presented side by side in FIG. 17.

The different matrices are then added linearly and the result of the combination yields the table shown in FIG. 18.

The general structure of a low-pass filter is indeed obtained. One will observe the values at zero when the two combined filters are joined, which indicates that aliasing compensation is no longer necessary here, as expected, and the passband has M/4 coefficients.

It is also possible to weight the above two filters to achieve a more complex filtering function. For example, a filtering function can be implemented:

applying a factor g=10 to the frequencies below M/8, keeping the frequencies between M/8 and M/4 at their initial value, and cutting off any frequency above M/4.

In this example embodiment, the elements of the two matrices shown in FIG. 19 are considered.

The two matrices can be summed as in the embodiment presented in FIG. 20. Thus any kind of equalization range can be reproduced by combining basic weighted band-pass functions (and/or low-pass functions), by summing them.

Thus, in general terms, starting from a desired filtering function expressed as a series of gains to be applied to each band of a transform, one reflects these gains in the main diagonal of matrix $T_0$. These gains can be adjusted in order to limit discontinuities from one band to another (typically the values of the $a_0$ coefficients).

For each difference in gains between two bands, the respective gains are weighted by aliasing reduction ranges defining a modification to matrices $T_1$ and $T'_1$ in order to weight the preceding and following frames in the transformed domain.

Then the filtering is applied.

Thus, for each signal frame in the MDCT transformed domain, three consecutive frames (represented in vector form) are respectively multiplied by the filtering matrices:

$T_1$, for the frame preceding the current frame to be filtered, $T_0$, for the current frame to be filtered, and $T'_1$, for the frame following the current frame, and the contributions of the results are summed.

This obtains a spectrum in the MDCT transformed domain, and an MDCT inverse transformation is applied in order to obtain a time signal having the desired filtering characteristics.

This approach extends to a complex-valued transform (for example MCLT) and more generally to any modulated and possibly complex-valued transform.

Figure 13:
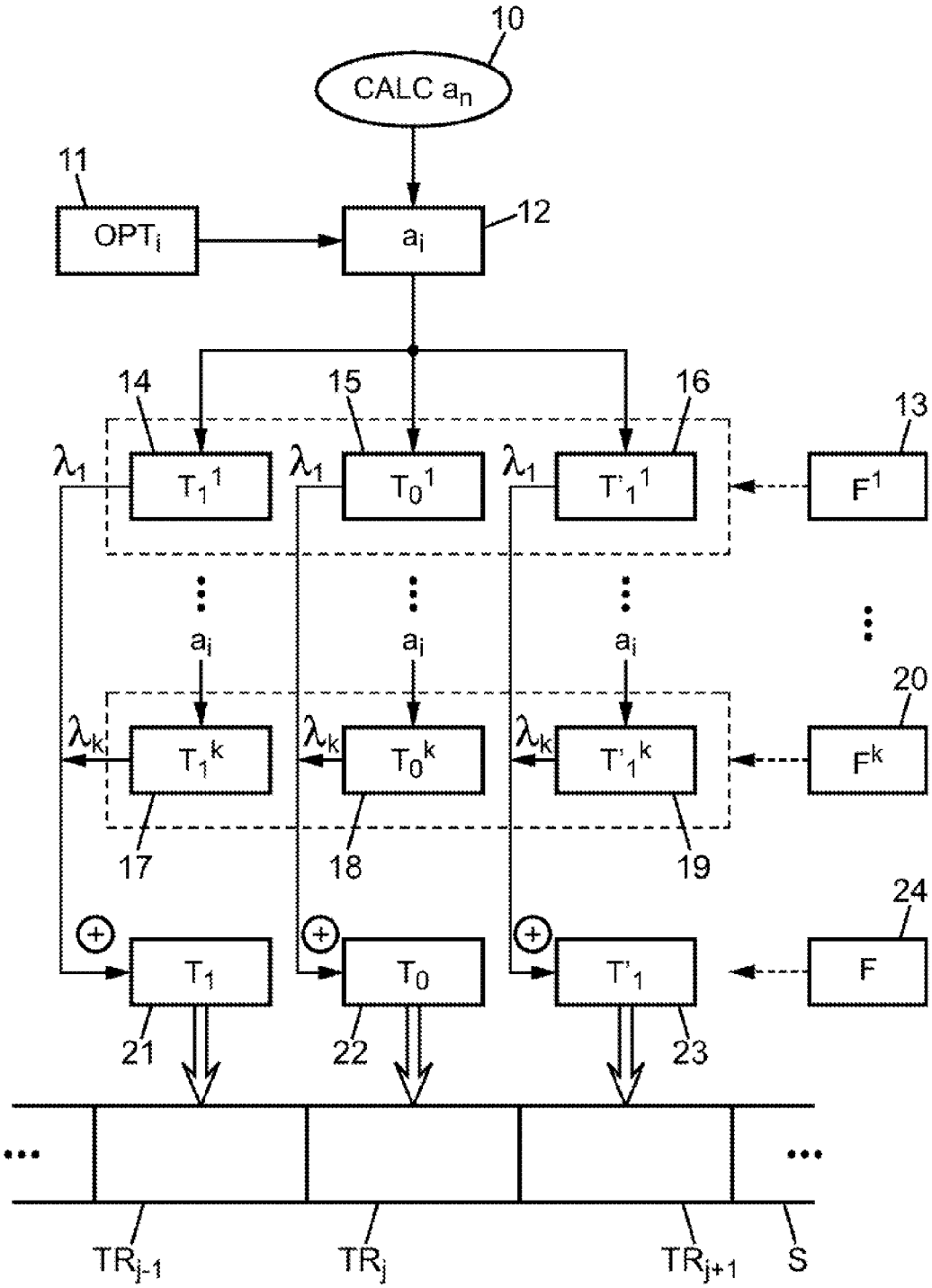

FIG. 13 summarizes the main steps of an example embodiment of a method according to the invention.

In a first step 10, for a given filtering, for example band-pass (low-pass or high-pass being considered as special cases of band-pass), all the sets of coefficients are determined:

$a_0, a_1,$ $a_0, a_1, a_2,$ $a_0, a_1, a_2, a_3,$

. . . , $a_0, a_1, a_2, a_3, \ldots, a_n$, for example where n=5, which allow constructing the matrices $T_0$, $T_1$, $T'_1$ that minimize distortion due to aliasing. This step 10 can be performed beforehand, "off-line".

Next, for a current "on-line" step 11, which for example must comply with a complexity criterion, a set of coefficients $a_0, a_1, \ldots, a_i$ are chosen where i is less than or equal to n, such that the index i fulfills a compromise between filtering complexity/quality, determined for example as a function of the computational power of one terminal or another, or by determining a quality level according to the quality of the audio encoding. In effect, an encoded audio signal is inevitably distorted: it is therefore unnecessary to reduce the aliasing to values significantly below the noise level generated by the encoding. The value of the index i can therefore be determined in this step 11 as a function of these conditions, and in the next step 12, the set of coefficients $a_0, a_1, \ldots, a_i$ corresponding to the value chosen for the index i is fetched for example from memory.

For a given filtering F (step 24), all the component filterings ($F^1, F^2, \ldots, F^k$) of this given filtering are determined, for example a low-pass $F^1$ (step 13), a high-pass $F^2$ (therefore forming a band-pass, by subtraction, with the component filtering $F^1$), a complex filtering $F^k$ (step 20), or other. In particular, the general filtering F can result from a linear combination of the component filterings:

$$F=\lambda_1 F^1+\ldots+\lambda_k F^k$$

A weighting term $\lambda_k$ is thus applied to the matrices $T_0^k$, $T_1^k$, $T'^k_1$ corresponding to each component filtering $F^k$ (steps 14 to 20), and the weighted matrices are summed one by one to obtain the matrices $T_0$, $T_1$, $T'_1$ ultimately corresponding to the general filtering F (steps 21 to 23) and respectively applied to the vectors representing a given frame $TR_j$, a preceding frame $TR_{j-1}$, and a following frame $TR_{j+1}$. As indicated above, the matrix $T'_1$ can also be deduced from the matrix $T_1$ by transposition.

The present invention also concerns a computer program comprising instructions for implementing the method of the invention when this program is executed by a processor. One can see that FIG. 13 can correspond to a flowchart of the general algorithm of such a program.

The present invention also relates to a device for carrying out the method and therefore comprising means for filtering in a transformed domain of sub-bands. In particular, these means apply:

equalization processing to a current block in the transformed domain, and filtering-adjustment processing, in the transformed domain, to at least one block adjacent to the current block.

Figure 14:
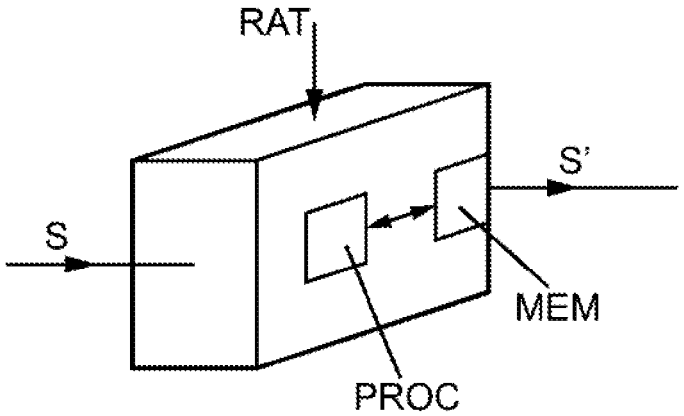

An example embodiment of such a device is represented in FIG. 14, with, in the example represented:

an input for receiving a signal S to be processed in the domain of sub-bands, a second optional input for receiving conditions for determining said index i, in order to choose a set of coefficients $a_0, a_1, \ldots, a_i$ adapted for a compromise between filtering complexity/quality, signal processing means such as, for example, a processor PROC and a working memory MEM, and an output providing the filtered signal S'.

The present invention is not limited to the example embodiments described above; it extends to other variants.

For example, embodiments were presented with three consecutive spectra issuing from the processing of successive frames by matrices $T_1$, $T_0$, $T'_1$. However, the number of frames to be processed can be larger when wanting to implement filters with a longer finite impulse response.

In addition, in a filtering method using a prototype analysis filter that is different from a prototype synthesis filter (forms of filtering referred to as "analysis and synthesis windows"), the filtering-adjustment processing by equalization can be applied to a number of frames preceding the current frame that is different from the number of frames following the current frame. For example, it is possible to process only one frame adjacent to the current frame (preceding or following). In this case an asymmetrical linear filter is obtained.

Processing matrices (in particular matrices $T_1$ and $T'_1$) adapted for MDCT transforms have been described, particularly the position of the non-zero matrix elements. However, these forms of matrices can have variants for other types of transforms. For example, the matrix $T'_1$ can be in a form that is not the transpose of the matrix $T_1$ for a different type of transform than the MDCT transform with Malvar filters as implemented here.

The invention claimed is:

1. A method for processing an audio signal in an encoding process of said audio signal, said audio signal being in the form of consecutive blocks of samples, the method comprising the steps of:

receiving said audio signal through an input interface;

applying said audio signal to a processing circuit for encoding said audio signal; and feeding an output interface with the audio signal thus encoded, said output interface cooperating with a network interface so as to transmit said encoded audio signal through a network;

wherein the step of applying the audio signal to a processing circuit comprises a filtering in a transformed domain of sub-bands, said filtering comprising:

equalization processing applied to a current block in the transformed domain, and filtering-adjustment processing applied in the transformed domain to at least one block adjacent to the current block, and wherein the filtering-adjustment processing is carried out by a filtering matrix system applying a matrix to said at least one block adjacent to the current block, said matrix comprising upper and lower diagonals comprising non-zero elements, said non-zero elements being identical in said upper and lower diagonals aside from the sign.

2. The method according to claim 1, comprising a prior step of optimizing the equalization and filtering-adjustment parameters, by estimating the aliasing resulting from the equalization.

3. The method according to claim 2, wherein the aliasing is estimated in a domain obtained from an inverse transform of the domain of sub-bands.

4. The method according to claim 1, wherein the equalization and filtering adjustment in the transformed domain comprise:

equalization processing applied to a current block, filtering-adjustment processing applied to at least one block temporally preceding the current block, and filtering-adjustment processing applied to at least one block temporally following the current block.

5. The method according to claim 4, wherein the current, previous, and following blocks are represented by signal vectors, and wherein the equalization and filtering adjustment including the application of a matrix system comprises:

a first matrix applied to the signal vector of the current block, a second matrix applied to the signal vector of the preceding block, and a third matrix applied to the signal vector of the following block.

6. The method according to claim 5, wherein the third matrix is the transpose of the second matrix.

7. The method according to claim 1, wherein, prior to the equalization and filtering adjustment, said blocks are transformed in the domain of the sub-bands by at least one modulated transform.

8. The method according to claim 1, wherein the current and adjacent blocks are represented by signal vectors, and wherein the equalization and filtering adjustment including the application of a matrix system comprises at least:

a first matrix applied to the signal vector of the current block, and a second matrix applied to the signal vector of the adjacent block and:

the first matrix applied to the signal vector of the current block comprises as the only non-zero elements a succession of identical elements A, in the diagonal of the matrix, followed by an element A-B for a given sub-band and an element B for the sub-band which follows the given sub-band, and the second matrix applied to the signal vector of the adjacent block comprises as the only non-zero elements at least two elements of identical absolute value and of opposite signs, arranged in the diagonal of the matrix, respectively for the given sub-band and for the sub-band which follows the given sub-band.

9. The method according to claim 8, wherein the filtering comprises a cutoff component for beyond a sub-band corresponding to said given sub-band.

10. The method according to claim 5, wherein it comprises a prior step of optimizing the equalization and filtering-adjustment parameters, by estimating the aliasing resulting from the equalization, and wherein the second and third matrices comprise a number of non-zero elements which is a function of the chosen degree of optimization of the filtering-adjustment parameters, minimizing the estimated aliasing.

11. The method according to claim 8, wherein, for a lowpass filtering, the first matrix is expressed in the form:

$$T_0 = \begin{pmatrix} 1 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 1 & 0 & 0 & 0 & 0 & 0 & \dots & 0 \\ 0 & \dots & 0 & 1 & 0 & 0 & 0 & 0 & \dots & 0 \\ 0 & \dots & 0 & 0 & 1-a_0 & 0 & 0 & 0 & \dots & 0 \\ 0 & \dots & 0 & 0 & 0 & a_0 & 0 & 0 & \dots & 0 \\ 0 & \dots & 0 & 0 & 0 & 0 & 0 & 0 & \dots & 0 \\ 0 & \dots & 0 & 0 & 0 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix},$$

the coefficient $1-a_0$ being applied for the given sub-band, wherein the second matrix is expressed in the form:

$$T_1 = \begin{pmatrix} 0 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 0 & 0 & 0 & a_5 & 0 & 0 & \dots & 0 \\ 0 & \dots & 0 & 0 & a_3 & 0 & -a_4 & 0 & \dots & 0 \\ 0 & \dots & 0 & -a_3 & -a_1 & -a_2 & 0 & a_5 & \dots & 0 \\ 0 & \dots & -a_5 & 0 & a_2 & a_1 & a_3 & 0 & \dots & 0 \\ 0 & \dots & 0 & a_4 & 0 & -a_3 & 0 & 0 & \dots & 0 \\ 0 & \dots & 0 & 0 & -a_5 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix},$$

the coefficient $-a_1$ of the diagonal being applied for the given sub-band, and wherein the third matrix is expressed in the form:

$$T_1' = \begin{pmatrix} 0 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 0 & 0 & 0 & -a_5 & 0 & 0 & \dots & 0 \\ 0 & \dots & 0 & 0 & -a_3 & 0 & a_4 & 0 & \dots & 0 \\ 0 & \dots & 0 & a_3 & -a_1 & a_2 & 0 & -a_5 & \dots & 0 \\ 0 & \dots & a_5 & 0 & -a_2 & a_1 & -a_3 & 0 & \dots & 0 \\ 0 & \dots & 0 & -a_4 & 0 & a_3 & 0 & 0 & \dots & 0 \\ 0 & \dots & 0 & 0 & a_5 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix}$$

the coefficient $-a_1$ of the diagonal being applied for the given sub-band, the coefficients $a_0$, $a_1$, $a_2$, $a_3$, $a_4$ and $a_5$ being positive real numbers, with at least the real number $a_1$ being non-zero.

12. The method according to claim 8, wherein, as the filtering comprises a linear combination of multiple filterings, the matrix system comprises at least:

a corresponding linear combination of first matrices, applied to the signal vector of the current block, a linear combination of second matrices, applied to the signal vector of the preceding block, and a linear combination of third matrices, respective transposes of second matrices, applied to the signal vector of the following block.

13. A non-transitory computer-readable medium, storing a computer program comprising instructions for implementing the method according to claim 1 when this program is executed by a processor.

14. A coding device for processing an audio signal in the form of consecutive blocks of samples, comprising:

a network interface for receiving said audio signal, a processing circuit for decoding said audio signal, an output interface for delivering the audio signal thus decoded, wherein the processing circuit comprises a circuit for filtering said signal in a transformed domain of sub-bands, wherein said circuit is programmed for applying:

equalization processing to a current block in the transformed domain, and filtering-adjustment processing, in the transformed domain, to at least one block adjacent to the current block, and wherein the filtering-adjustment processing is carried out by a filtering matrix system applying a matrix to said at least one block adjacent to the current block, said matrix comprising upper and lower diagonals comprising non-zero elements, said non-zero elements being identical in said upper and lower diagonals aside from the sign.

15. A decoding device for processing an audio signal in the form of consecutive blocks of samples, comprising:

a network interface for receiving said audio signal;

a processing circuit for decoding said audio signal;

an output interface for delivering said audio signal thus decoded;

wherein the processing circuit comprises a circuit for filtering said signal in a transformed domain of sub-bands, wherein said circuit is programmed for applying:

equalization processing to a current block in the transformed domain, and filtering-adjustment processing, in the transformed domain, to at least one block adjacent to the current block, and wherein the filtering-adjustment processing is carried out by a filtering matrix system applying a matrix to said at least one block adjacent to the current block, said matrix comprising upper and lower diagonals comprising non-zero elements, said non-zero elements being identical in said upper and lower diagonals aside from the sign.

16. A method for processing an audio signal in a decoding process of said audio signal, said audio signal being in the form of consecutive blocks of samples, the method comprising the steps of:

receiving said audio signal through a network interface;

applying said audio signal to a processing circuit for decoding said audio signal; and delivering the audio signal thus decoded through an output interface;

wherein the step of applying the audio signal to a processing circuit comprises a filtering in a transformed domain of sub-bands, said filtering comprising:

equalization processing applied to a current block in the transformed domain, and filtering-adjustment processing applied in the transformed domain to at least one block adjacent to the current block, and wherein the filtering-adjustment processing is carried out by a filtering matrix system applying a matrix to said at least one block adjacent to the current block, said matrix comprising upper and lower diagonals comprising non-zero elements, said non-zero elements being identical in said upper and lower diagonals aside from the sign.

17. The method according to claim 16, comprising a prior step of optimizing the equalization and filtering-adjustment parameters, by estimating the aliasing resulting from the equalization.

18. The method according to claim 17, wherein the aliasing is estimated in a domain obtained from an inverse transform of the domain sub-bands.

19. The method according to claim 16, wherein the equalization and filtering adjustment in the transformed domain comprise:

equalization processing applied to a current block;

filtering-adjustment processing applied to at least one block temporally preceding the current block; and filtering-adjustment processing applied to at least one block temporally following the current block.

20. The method according to claim 19, wherein the current, previous, and following blocks are represented by signal vectors, and wherein the equalization and filtering adjustment including the application of a matrix system comprises:

a first matrix applied to the signal vector of the current block;

a second matrix applied to the signal vector of the preceding block; and a third matrix applied to the signal vector of the following block.

21. The method according to claim 20, wherein the third matrix is the transpose of the second matrix.

22. The method according to claim 16, wherein, prior to the equalization and filtering adjustment, said blocks are transformed in the domain of the sub-hands by at least one modulated transform.

23. The method according to claim 16, wherein the current and adjacent blocks are represented by signal vectors, and wherein the equalization and filtering adjustment including the application of a matrix system comprises at least:

a first matrix applied to the signal vector of the current block;

a second matrix applied to the signal vector of the adjacent block; and the first matrix applied to the signal vector of the current block comprises as the only non-zero elements a succession of identical elements A, in the diagonal of the matrix, followed by an element A-B for a given sub-band and an element B for the sub-band which follows the given sub-band, and the second matrix applied to the signal vector of the adjacent block comprises as the only non-zero elements at least two elements of identical absolute value and of opposite signs, arranged in the diagonal of the matrix, respectively for the given sub-band and for the sub-band which follows the given sub-band.

24. The method according to claim 23, wherein the filtering comprises a cutoff component for beyond a sub-band corresponding to said given sub-band.

25. The method according to claim 20, wherein it comprises a prior step of optimizing the equalization and filtering-adjustment parameters, by estimating the aliasing resulting from the equalization, and wherein the second and third matrices comprise a number of non-zero elements which is a function of the chosen degree of optimization of the filtering-adjustment parameters, minimizing the estimated aliasing.

26. The method according to claim 23, wherein for a low-pass filtering, the first matrix is expressed in the form:

$$T_0 = \begin{pmatrix} 1 & \dots & 0 & 0 & 0 & 0 & 0 & 0 & \dots & 0 \\ \vdots & \ddots & \vdots & \vdots & \vdots & \vdots & \vdots & \vdots & \ddots & \vdots \\ 0 & \dots & 1 & 0 & 0 & 0 & 0 & 0 & \dots & 0 \\ 0 & \dots & 0 & 1 & 0 & 0 & 0 & 0 & \dots & 0 \\ 0 & \dots & 0 & 0 & 1-a_0 & 0 & 0 & 0 & \dots & 0 \\ 0 & \dots & 0 & 0 & 0 & a_0 & 0 & 0 & \dots & 0 \\ 0 & \dots & 0 & 0 & 0 & 0 & 0 & 0 & \dots & 0 \\ 0 & \dots & 0 & 0 & 0 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix},$$

the coefficient $1-a_0$ being applied for the given sub-band, wherein the second matrix is expressed in the form:

$$T_1 = \begin{pmatrix} 0 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 0 & 0 & 0 & a_5 & 0 & 0 & \dots & 0 \\ 0 & \dots & 0 & 0 & a_3 & 0 & -a_4 & 0 & \dots & 0 \\ 0 & \dots & 0 & -a_3 & -a_1 & -a_2 & 0 & a_5 & \dots & 0 \\ 0 & \dots & -a_5 & 0 & a_2 & a_1 & a_3 & 0 & \dots & 0 \\ 0 & \dots & 0 & a_4 & 0 & -a_3 & 0 & 0 & \dots & 0 \\ 0 & \dots & 0 & 0 & -a_5 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix},$$

the coefficient $-a_1$ of the diagonal being applied for the given sub-band, and wherein the third matrix is expressed in the form:

$$T_1' = \begin{pmatrix} 0 & \dots & 0 & 0 & 0 & 0 & 0 & 0 & \dots & 0 \\ \vdots & \ddots & \vdots & \vdots & \vdots & \vdots & \vdots & \vdots & \ddots & 0 \\ 0 & \dots & 0 & 0 & 0 & -a_5 & 0 & 0 & \dots & 0 \\ 0 & \dots & 0 & 0 & -a_3 & 0 & a_4 & 0 & \dots & 0 \\ 0 & \dots & 0 & a_3 & -a_1 & a_2 & 0 & -a_5 & \dots & 0 \\ 0 & \dots & a_5 & 0 & -a_2 & a_1 & -a_3 & 0 & \dots & 0 \\ 0 & \dots & 0 & -a_4 & 0 & a_3 & 0 & 0 & \dots & 0 \\ 0 & \dots & 0 & 0 & a_5 & 0 & 0 & 0 & \dots & 0 \\ 0 & \ddots & \vdots & \vdots & \vdots & \vdots & \vdots & \vdots & \ddots & 0 \\ 0 & \dots & 0 & 0 & 0 & 0 & 0 & 0 & 0 & 0 \end{pmatrix}$$

the coefficient $-a_1$ of the diagonal being applied for the given sub-band, the coefficients $a_0$, $a_1$, $a_2$, $a_3$, $a_4$ and $a_5$ being positive real numbers, with at least the real number $a_1$ being non-zero.

27. The method according to claim 23, wherein, as the filtering comprises a linear combination of multiple filterings, the matrix system comprises at least:

a corresponding linear combination of first matrices, applied of the signal vector of the current block;

a linear combination of second matrices, applied to the signal vector of the preceding block; and a linear combination of third matrices, respective transposes of second matrices, applied of the signal vector of the following block.

28. A non-transitory computer-readable medium, storing a computer program comprising instructions for implementing the method according to claim 16 when the computer program is executed by a processor.

* * * * *